US005673620A

United States Patent [19]

Negishi et al.

[11] Patent Number: 5,673,620

[45] Date of Patent: Oct. 7, 1997

[54] STENCIL PRINTING DRUM

[75] Inventors: Hideo Negishi; Yasuhiro Takahashi, both of Ibaraki-ken, Japan

[73] Assignee: Riso Kagaku Corporation, Tokyo, Japan

[21] Appl. No.: 623,183

[22] Filed: Mar. 28, 1996

[30] Foreign Application Priority Data

Apr. 3, 1995 [JP] Japan ..... 7-07773

[51] Int. Cl.[6] ..... B41L 13/04

[52] U.S. Cl. ..... 101/120; 101/116

[58] Field of Search ..... 101/125, 127.1, 101/128.21, 128.4, 114, 116, 119, 120; 118/406, 409

[56] References Cited

U.S. PATENT DOCUMENTS 4,664,031 5/1987 McKillip ..... 101/127.1
5,090,312 2/1992 Ohinata ..... 101/120
5,251,566 10/1993 Kobayasi et al. ..... 101/116
5,255,599 10/1993 Kobayasi et al. ..... 101/119
5,477,779 12/1995 Kawabe ..... 101/116
5,572,928 11/1996 Negishi ..... 101/119

FOREIGN PATENT DOCUMENTS 3216466 11/1983 Germany .

*Primary Examiner*—Ren Yan
*Attorney, Agent, or Firm*—Kanesaka & Takeuchi

[57] ABSTRACT

A stencil printing screen body includes an ink-previous printing area, an ink-impervious non-printing area provided around the printing area, and a pressure sensitive adhesive area formed on the surface where the stencil sheet of non-printing area is attached and having adhesion to the stencil sheet. The stencil printing body is wrapped in a cylindrical form on peripheral surfaces of annular members, and a squeeze member is provided in the screen body for supplying ink. The stencil sheet is applied onto the screen body without leaking ink.

7 Claims, 6 Drawing Sheets

STENCIL PRINTING DRUM

BACKGROUND OF THE INVENTION

The present invention relates to a stencil printing drum and, more particularly, to a structure for preventing ink leakage from between the screen body and a stencil sheet.

A conventional stencil printing apparatus shown in FIG. 6 is provided with a printing drum comprising a pair of annular members which are aligned on the center axis and connected with a connecting member; on the peripheral surface of these annular members, a stencil printing screen body 100 is wrapped in a cylindrical form. The drum is driven to rotate in a specific direction indicated by the arrow A by means of a driving means. The stencil printing screen body 100 forming the peripheral surface of the drum has an ink-pervious printing area 101 at the central part thereof. Around the printing area 101 an ink-impervious non-printing area 102 is provided. Within the printing drum are provided an ink supply roller 104 as a squeeze member which contacts the inner peripheral surface of the stencil printing screen body 100 to supply ink 103, and an inking roller 105 for applying the ink 103 to the ink supply roller 104. On the outer peripheral surface of the stencil printing screen body 100 a stencil sheet S is wrapped. The stencil sheet S thus wrapped covers the printing area 101 astride a non-printing area 102 of the stencil sheet screen body 100. The leading end of the wrapped stencil sheet S is secured by a clamping means provided on the connecting member and so on, but is not secured on the stencil printing screen body 101. Below the printing drum a press roller 106 is vertically movably mounted to press printing paper against the stencil sheet S on the printing drum.

The printing sheet is held between the rotating printing drum and the press roller 106. The ink 103 supplied to the inner peripheral surface of the stencil printing screen body 100 by means of the ink supply roller 104 is fed out of the stencil printing screen body 100 from the printing area 101, where ink is transferred to the printing paper through perforated image section of the stencil sheet S wrapped around the outer periphery of the stencil printing screen body 100.

Excessive ink 103*a* that has not been consumed in printing is sent little by little rearwardly in the direction of rotation of the drum (that is, in the reverse direction of rotation A of the printing drum) with a pressure received from the stencil printing screen body 100 held under pressure between the ink supply roller 104 and the press roller 106. In the process in which the excessive ink 103*a* reaches the last end section of the printing area 101, the excessive ink is partly fed back into the printing drum, while the other part of the excessive ink 103*a* blocked at the trailing end of the printing area as shown in FIG. 6 gradually enters between the non-printing area 102 of the stencil printing screen body 100 and the stencil sheet S, then leaking out of the printing drum from the last end section of the stencil sheet S to smear the paper with the ink.

SUMMARY OF THE INVENTION

It is therefore an object of the present invention to provide a stencil printing drum with a screen body which can prevent excessive ink not transferred to the printing paper from leaking at the trailing end section of a stencil sheet.

The stencil printing screen body of the first aspect of the present invention has an ink-pervious printing area, an ink-impervious non-printing area provided around the printing area, and a pressure sensitive adhesive layer, which can adhere to the stencil sheet, formed on a surface of the side on which the stencil sheet in the non-printing area is attached.

The stencil printing screen body of the second aspect of the present invention is the stencil printing screen body according to the first aspect, which is a cylindrical body driven to rotate with the stencil sheet wrapped on the outer peripheral surface thereof.

The stencil printing screen body of the third aspect of the present invention is the stencil printing screen body according to the first aspect, further comprising: a pair of annular members aligned on the common center axis, said stencil printing screen body being wrapped into a cylindrical form on the peripheral surface of said annular members, and a squeeze member provided inside said stencil printing screen body for supplying ink thereto.

The stencil printing screen body of the fourth aspect of the present invention is the stencil printing screen body claimed in the second aspect, in which the printing area has both sides substantially in parallel with the direction of rotation of the stencil printing screen body, a leading end side located at the front side in the direction of rotation, and a trailing end side located at the rear side in the direction of rotation, and the pressure sensitive adhesive layer is provided at least along the trailing end side in the non-printing area adjacently to the trailing end.

The stencil printing screen body of the fifth aspect of the present invention is the stencil printing screen body claimed in the second aspect, in which the printing area is substantially in parallel on both sides with the direction of rotation of the stencil printing screen body, and has a leading end side located at the front side in the direction of rotation, and a trailing end side located at the rear side in the direction of rotation, and the pressure sensitive adhesive layer is formed in a shape of rectangular frame which encloses the printing area.

The stencil printing screen body of the sixth aspect of the present invention is the stencil printing screen body according to the second aspect, in which the pressure sensitive adhesive layer is composed of a high-molecular compound having pressure sensitive adhesion.

The stencil printing screen body of the seventh aspect of the present invention is the stencil printing screen body according to the second aspect, comprising a plurality of screen members which are layered.

The stencil printing screen body of the eight aspect of the present invention is the stencil printing screen body according to the fourth aspect, in which the ink-pervious area is formed on the back side of the pressure sensitive adhesive layer which is adjacent to the rear end side of the printing area in the direction of rotation of the stencil printing screen body.

According to the above-mentioned constitution, the following function is obtained. A stencil sheet wrapped around the stencil printing screen body adheres fast on the pressure sensitive adhesive layer of the stencil printing screen body. Ink is supplied to the stencil printing screen body from the opposite side of the stencil sheet, and stencil printing is performed with the printing paper pressed against the stencil sheet. Excessive ink not used in printing is gradually sent in the direction of printing with a pressure applied at the time of printing. The excessive ink, at the last end section of the printing area, will not go out of the stencil sheet into the non-printing area of the stencil printing screen body because the stencil sheet is attached fast on the stencil printing screen body through the pressure sensitive adhesive layer.

The foregoing object and other objects and advantages of the present invention will become apparent from a study of the following specification, taken in connection with the accompanying drawings.

DESCRIPTION OF THE PREFERRED EMBODIMENT

Figure 1:
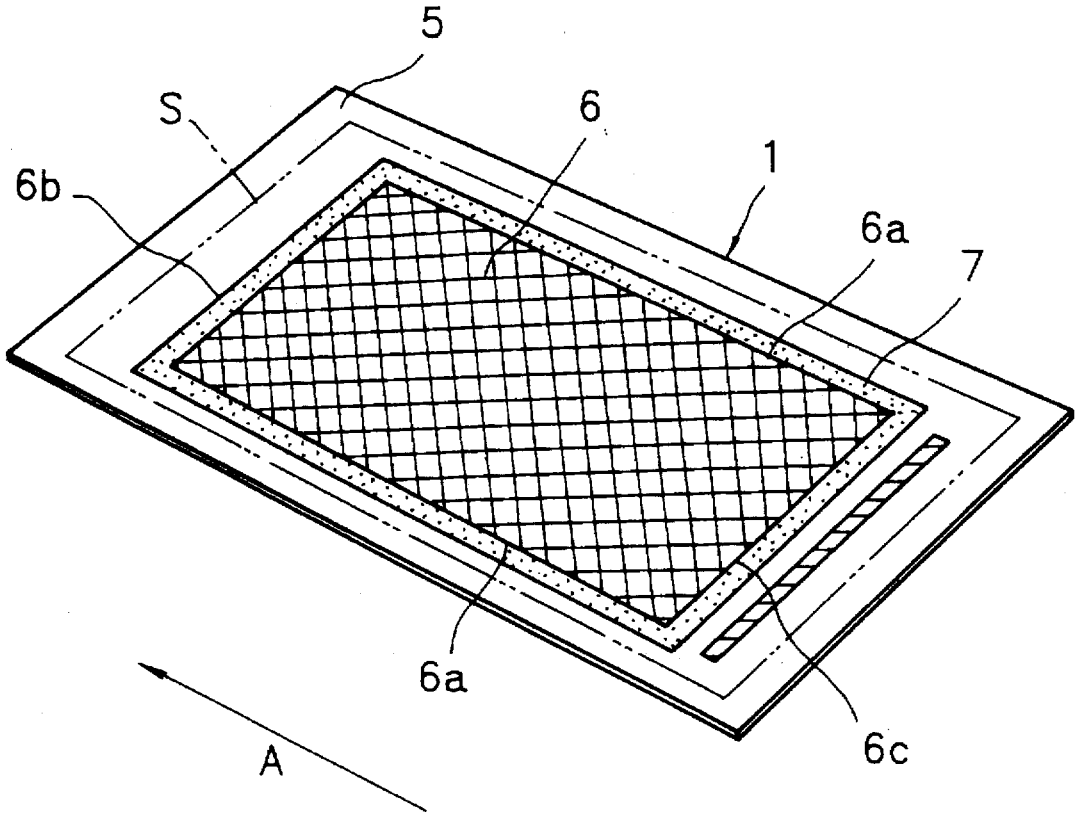
FIG. 1 is a perspective view showing one embodiment of a stencil printing screen body.
Figure 2:
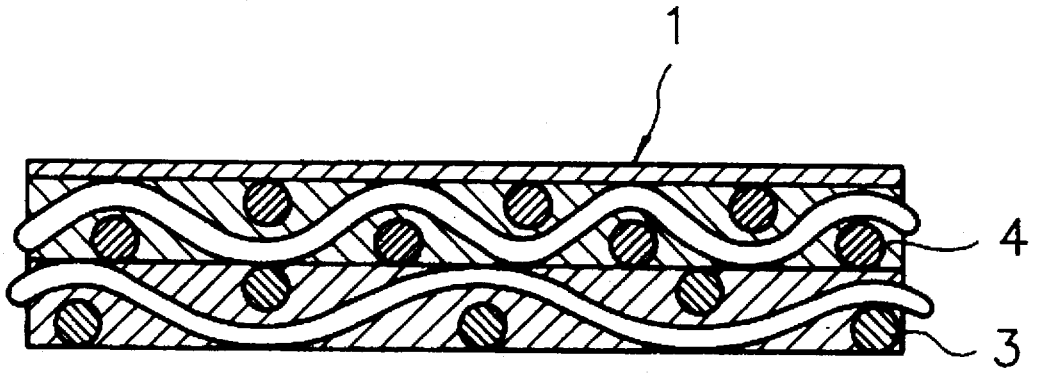
FIG. 2 is a partly sectional view of one embodiment of the stencil printing screen body.

One preferred embodiment of a stencil printing screen body 1 and a stencil printing apparatus 2 equipped with the stencil printing screen body 1 will be explained with reference to FIGS. 1 to 4. As shown in FIG. 2, the stencil printing screen body 1 is an integrated type produced by laminating an outer screen member 4 of a 305-mesh screen made of synthetic fiber such as polyester or other upon an inner screen member 3 of a 50-mesh screen made of metal such as stainless steel. As shown in FIG. 1, the stencil printing screen body 1 is a rectangular type, and along an outer peripheral edge an ink-impervious non-printing area 5 is provided in a form of rectangular frame. This ink-impervious area 5 is formed by sealing both the screen members 3 and 4 with a heat softening resin (e.g., a thermoplastic polyurethane resin) molten into the screen members 3 and 4 thus laminated. The screen members 3 and 4 are integrally jointed in the non-printing area 5, to substantially constitute a single screen body. Inside the non-printing area 5 formed in the shape of rectangular frame an ink-pervious printing area 6 remains in a rectangular form.

The rectangular stencil printing screen body 1 of the present embodiment is formed in a cylindrical form, and is used as a component of the printing drum of the stencil printing apparatus 2. Four sides defining the rectangular printing area 6 of the stencil printing screen body 1 include both sides 6*a*, 6*a* substantially parallel with the direction of rotation A, a leading end side 6*b* at the front side in the direction of rotation, and a trailing end side 6*c* at the rear side in the direction of rotation. The direction of rotation A stated above is the direction of rotation of the stencil printing screen body 1 which constitutes the printing drum 2.

The stencil sheet S that has been perforated is wrapped around the outer peripheral surface of the stencil printing screen body 1 of the present embodiment shaped in a cylindrical form to constitute the printing drum of the stencil printing apparatus 2. On the surface around which the stencil sheet S is wrapped a pressure sensitive adhesive layer 7 having pressure sensitive adhesion with respect to the stencil sheet S is formed. The pressure sensitive adhesive layer 7 of the present embodiment is formed in a shape of rectangular frame along the four sides 6*a*, 6*a*, 6*b* and 6*c* which enclose the printing area 6. It should be noticed that the pressure sensitive adhesive layer 7 of the present embodiment is an about 0.1 mm-thick silicone rubber layer formed on the non-printing area 5 along the four sides 6*a*, 6*a*, 6*b* and 6*c* of the printing area 6, but is not limited thereto and can be produced of a high-molecular compound having adhesion such as silicone resin, urethane rubber, urethane resin, etc. If the pressure sensitive adhesive layer 7 is excessively thick, there will be formed a step between the pressure sensitive adhesive layer 7 and the printing area 6 or the non-printing area 5. In this case, when the press roller 8 is pressed against the printing paper P, the stencil sheet S wrapped around the stencil printing screen body 1 will wrinkle.

In the non-printing area 5 of the stencil printing screen body 1, a band-like ink-pervious area 9 is formed in parallel with the rear end side 6*c* of the printing area 6 behind a part of the aforesaid pressure sensitive adhesive layer which is adjacent to the rear end side 6*c* of the printing area 6. The ink-pervious area 9 is of the same constitution as the printing area 6, where the two laminated screen bodies 3 and 4 are not sealed. In case the ink 10 is supplied to the inner peripheral surface of the stencil printing screen body 1, if excessive ink remaining unused after printing excessively increases and partly leaks over the pressure sensitive adhesive layer 7 from the rear end side 6*c* of the printing area 6 into an area between the outer peripheral surface of the non-printing area 5 of the stencil printing screen body 1 and the stencil sheet S, the ink 10 returns from the ink-pervious area 9 to the inner peripheral surface of the stencil printing screen body 1.

Figure 3:
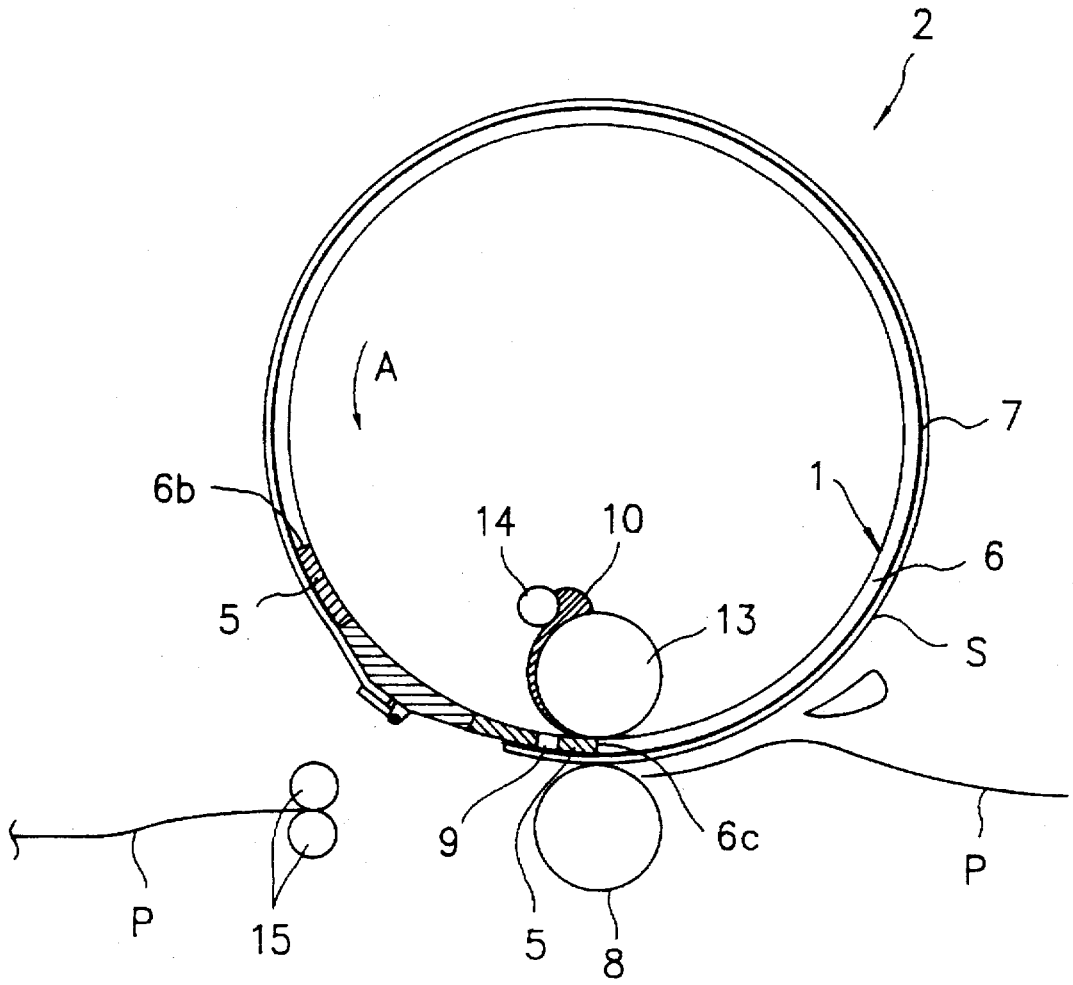
FIG. 3 is a sectional view of the stencil printing apparatus of one embodiment having the stencil printing screen body.
Figure 4:
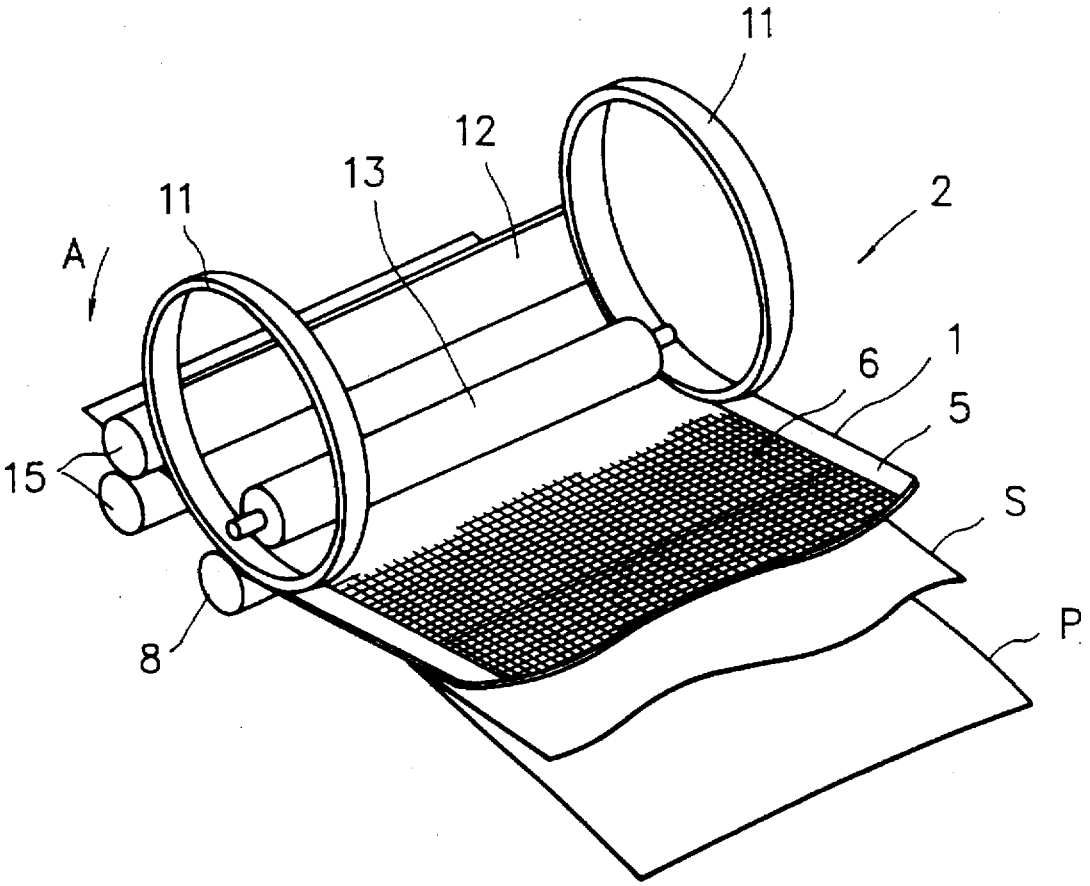
FIG. 4 is an exploded perspective view of the stencil printing apparatus of one embodiment having the stencil printing screen body.

As shown in FIGS. 3 and 4, the stencil printing screen body 1 is formed cylindrical, and used as a component of the printing drum 2 of the stencil printing apparatus. This printing drum 2 has a pair of annular members 11, 11. The pair of annular members 11, 11, which is aligned on the center axis, is connected by a connecting member 12. Around the peripheral surface of the annular members 11, 11 the stencil printing screen body 1 is wrapped in a cylindrical form, constituting the printing drum.

The stencil printing screen body 1 is wrapped in such a manner that the screen member 4 consisting of a fine-mesh screen body produced of a synthetic resin such as polyester will come outside. The leading end section of the stencil printing screen body 1 is secured to a fixing section of the ring-like frame body 11 or the connecting member 12, while the trailing end section is elastically secured through an elastic member such as a spring.

The two screen members 3 and 4 constituting the stencil printing screen body 1 are not bonded in the printing area 6. However, since the outer synthetic resin screen member 4 and the inner metal screen member 3 are curved in a cylindrical form as described above and the outer synthetic resin screen member 4 is firmly attached on the outer surface of the inner metal screen member, there will not arise such a disadvantage as occurrence of a space between the screen members 3 and 4 during printing in which the ink 10 will stay.

The printing drum 2 is driven to rotate by a driving means in a predetermined direction indicated by the arrow A. In the printing drum 2 are provided an ink supply roller 13 as a squeeze member for supplying the ink 10 in contact with the inner peripheral surface of the stencil printing screen body 1, and an inking roller 14 for applying the ink to the ink supply roller 13.

Around the outer peripheral surface of the stencil printing screen body 1 is wrapped the stencil sheet S. The stencil sheet S thus wrapped covers the printing area 6 astride the non-printing area 5 of the stencil printing screen body 1. The leading edge section of the wrapped stencil sheet S is secured by a clamping means provided on the connecting member 12 or other, but not secured on the stencil printing screen body 1.

Beneath the printing drum 2 the press roller 8 for pressing the printing paper P to the stencil sheet S wrapped around the drum is vertically movably mounted. On the side of the press roller 8 there are mounted paper feed rollers 15 for feeding the printing paper P.

Next, the function of the stencil printing screen body of the above constitution will be explained.

The perforated stencil sheet S is wrapped around the printing drum. That is, the leading end section of the stencil sheet S is fastened with a clamping means not illustrated, then is wrapped around the stencil printing screen body 1 in such a manner that the perforated image section of the stencil sheet S will correspond to the printing area 6 of the stencil printing screen body 1 and further the trailing end section of the stencil sheet S will cover the ink-pervious area 9. The stencil sheet S is secured fast on the pressure sensitive adhesive layer 7 of the stencil printing screen body 1. Between the printing area 6 of the stencil printing screen body 1 and the corresponding perforated image section of the stencil sheet S is formed one enclosed space by the frame-like pressure sensitive adhesive layer 7.

The printing paper P is fed from a paper feed apparatus not illustrated. Furthermore the printing paper P is carried by the paper feed rollers to the press roller 8 and the stencil sheet S wrapped around the stencil printing screen body 1 of the printing drum 2. With the rotation of the printing drum 2 the ink supply roller 13 supplies the ink 10 to the inner peripheral surface of the stencil printing screen body 1 of the printing drum. The printing paper P is held between the press roller 8 that has been raised and the printing drum 2, and the ink 10 supplied through the perforated section of the stencil sheet S is transferred to the printing paper P, thus performing stencil printing.

The excessive ink 10 that has not been consumed in printing receives a pressure from the stencil printing screen body 1 which is held and pressed between the ink supply roller 13 and the press roller 8, and is gradually rearwardly sent in the direction of rotational (in the opposite direction of rotation A of the printing drum). Since the stencil sheet S and the stencil printing screen body 1 contact fast through the pressure sensitive adhesive layer 7, the ink 10 will not flow under run out of the stencil sheet S and enter the non-printing area 5 of the stencil printing screen body 1 even if the excessive ink 10 has reached the trailing end section of the printing area 6.

Furthermore, if the ink 10 flows over the pressure sensitive adhesive section 7 adjacent to the trailing end section **6*c* of the printing area 6, ink receives a pressure between the stencil sheet S and the stencil printing screen body 1, to return to the inside of the stencil printing screen body 1 through the ink-pervious area 9 because the ink-pervious area 9 is provided adjacently to the direction of movement of the ink 10**.

Figure 5:
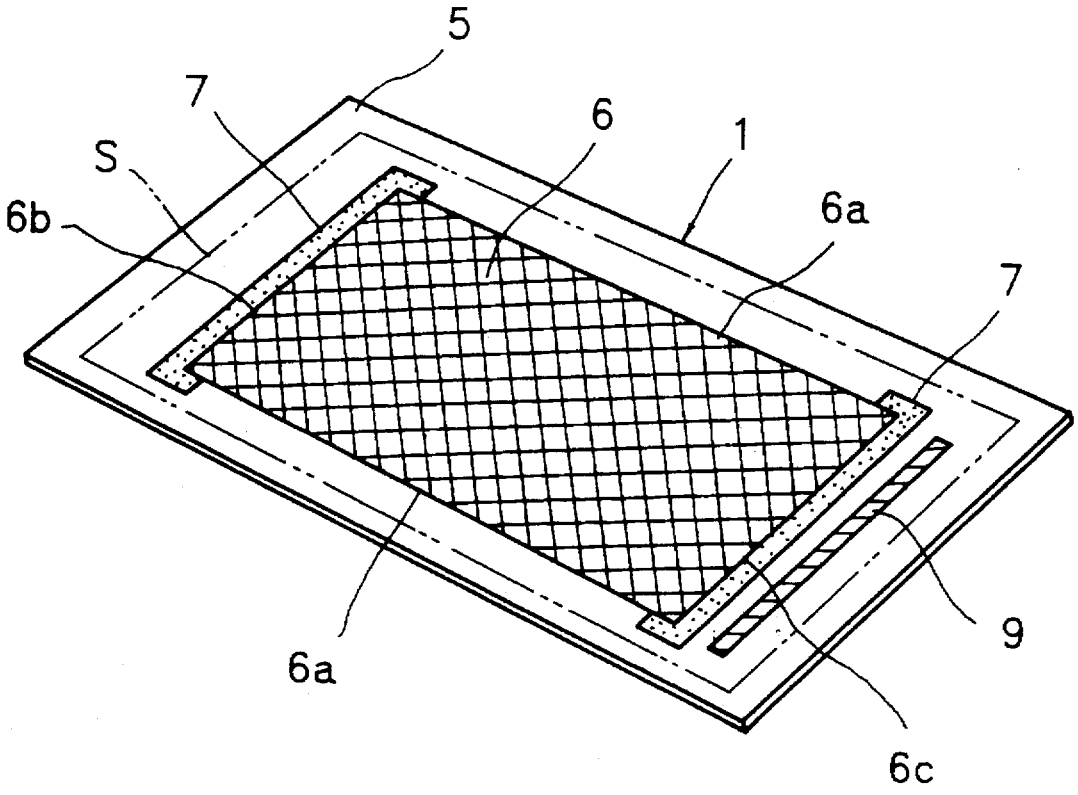
FIG. 5 is a perspective view showing another example of constitution of the stencil printing screen body.
Figure 6:
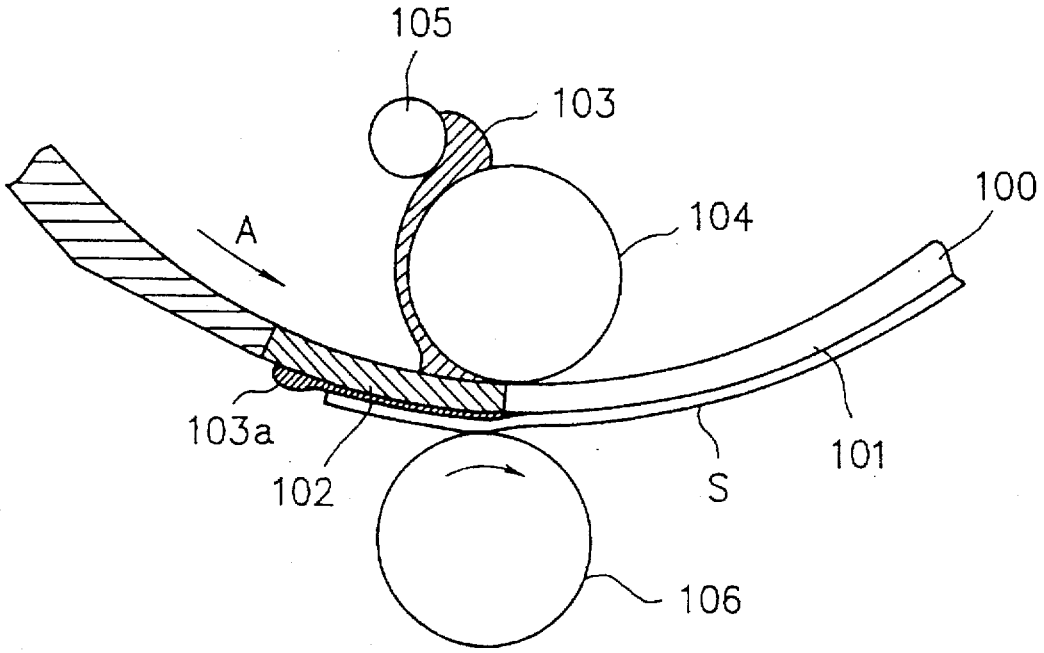
FIG. 6 Prior Art
FIG. 6 is a sectional view of a conventional stencil printing apparatus having a stencil printing screen body.

The pressure sensitive adhesive layer 7 of the present embodiment is formed in a shape of rectangular frame along four sides enclosing the printing area 6. This pressure sensitive adhesive layer 7 which holds the stencil sheet S may be provided in parts of both sides **6*a*, 6*a* and the leading end side 6*b*, and in parts of both sides 6*a*, 6*a* and to the trailing end section 6*c*, as shown in FIG. 5. The layer 7 should be formed at least along the trailing end side 6*c* of the printing area 6 where the ink 10** moves.

Furthermore, in the present embodiment, the pressure sensitive adhesive layer 7 and the non-printing area 5 are produced of different materials, but may be formed integrally with the same material as the heat-softening resin filled in the screen members 3 and 4 for the purpose of forming the non-printing area 5.

Furthermore, in the present embodiment, the stencil printing screen body 1 is composed of two layers of inner and outer screen members 3 and 4, but may be composed of three layers or more, or of a single layer.

Furthermore, in the present embodiment, the flexible stencil printing screen body i is wrapped around the pair of annular members 11, 11, but a stencil printing metal screen body 1 having predetermined rigidity may be shaped into a cylindrical form.

Furthermore, in the present embodiment, there is mounted the vertically movable press roller 8 beneath the printing drum which rotates in a fixed position to press the printing paper P against the printing drum, thus performing printing operation. The stencil printing may be performed by setting the press roller in a fixed position, arranging the printing drum having the flexible stencil printing screen body at a predetermined distance from the press roller, and pressing the stencil printing screen body to move outward by the vertically movable ink supply roller mounted inside the printing drum, to deform the stencil printing screen body to hold the printing paper P between the stencil sheet S and the press roller.

The stencil printing screen body of the present invention has a pressure sensitive adhesive layer for holding the stencil sheet at least in a part of the non-printing area, and the stencil sheet is secured in fast contact with the stencil printing screen body through the pressure sensitive adhesive layer; therefore the excessive ink that has not been consumed will not leak out from between the stencil printing screen body and the stencil sheet. Therefore the printing paper will never be smeared with the ink leaking out of the printing drum.

What is claimed is:

1. A stencil printing drum, comprising:

a pair of annular members aligned on a common center axis;

a stencil screen body wrapped in a cylindrical form on peripheral surfaces of the annular members, said stencil screen body including an ink-pervious printing area, an ink-impervious non-printing area provided around said printing area, and a pressure sensitive adhesive layer formed on an outer surface of said non-printing area where a stencil sheet is attached and having adhesion to said stencil sheet; and a squeeze member provided stencil screen body for supplying ink thereto.

2. A stencil printing drum according to claim 1, wherein said stencil printing screen body is cylindrical and wrapped with said stencil sheet on the outer surface.

3. A stencil printing drum according to claim 2, wherein said printing area has both sides substantially in parallel with a direction of rotation of said stencil printing screen body, a leading end side at a front side in said direction of rotation, and a trailing end side at a rear side in said direction of rotation; and said pressure sensitive adhesive layer is provided along said trailing end side in said non-printing area adjacent at least to said rear end side.

4. A stencil printing drum according to claim 3, wherein an ink-pervious area is formed on the rear side of said pressure sensitive adhesive layer adjacent to the trailing end side of said printing area in the direction of rotation of said stencil printing screen body.

5. A stencil printing drum according to claim 2, wherein said printing area has both sides substantially in parallel with a direction of rotation of said stencil printing screen body, a leading end side at a front side in said direction of rotation, and a trailing end side at a rear side in said direction of rotation; and said pressure sensitive adhesive layer is formed in a shape of rectangular frame enclosing said printing area.

6. A stencil printing drum according to claim 2, wherein said pressure sensitive adhesive layer is produced of a high-molecular compound having adhesion.

7. A stencil printing drum according to claim 2, wherein said stencil screen body comprises a plurality of screen members laminated in layers.

* * * * *